US005755168A

United States Patent [19]

Günther et al.

[11] Patent Number: 5,755,168

[45] Date of Patent: May 26, 1998

[54] SEQUIN DELIVERY SYSTEM FOR EMBROIDERY AND/OR SEWING MACHINES

[75] Inventors: Ludwig Günther, Chemnitz; Bernd Kirch, Krefeld; Heinz-Georg Slomma, Viersen; Hans-Rainer Gessman; Karl-Georg Helgert, both of Krefeld, all of Germany

[73] Assignee: ZSK Stickmaschinen G.M.B.H., Krefeld-Gartenstadt, Germany

[21] Appl. No.: 721,314

[22] Filed: Oct. 15, 1996

[30] Foreign Application Priority Data

Oct. 13, 1995 [DE] Germany ..... 195 38 084.3

[51] Int. Cl.[6] ..... D05B 3/24

[52] U.S. Cl. ..... 112/113

[58] Field of Search ..... 112/113, 106, 112/110, 114, 311, 152, 132, 99

[56] References Cited

U.S. PATENT DOCUMENTS

| | | | |
|---|---|---|---|
| 619,389 | 2/1899 | Cornely et al. | 112/99 |
| 2,935,958 | 5/1960 | Kuhn | 112/132 |
| 3,390,650 | 7/1968 | Ochsner | 112/88 |
| 4,067,273 | 1/1978 | Marforio | 112/152 X |
| 4,161,420 | 7/1979 | Clarke et al. | 156/73.3 |
| 4,722,289 | 2/1988 | Ohsawa | 112/311 X |
| 4,807,546 | 2/1989 | Lenson et al. | 112/113 X |
| 4,848,253 | 7/1989 | Tajima | 112/99 |

FOREIGN PATENT DOCUMENTS

| | | | |
|---|---|---|---|
| 537280 | 2/1957 | Canada | 112/113 |
| 0 643 162 A1 | 3/1995 | European Pat. Off. . | |
| A 1 167 563 | 11/1958 | France . | |
| 16 85 142 | 3/1972 | Germany . | |
| 30 35 958-A2 | 12/1988 | Germany . | |
| 37 37 041-A1 | 5/1989 | Germany . | |
| 9209764 U | 10/1992 | Germany . | |
| 44 18 384-A1 | 12/1994 | Germany . | |

*Primary Examiner*—Ismael Izaguirre
*Attorney, Agent, or Firm*—Milton Oliver Ware, Fressola, Van Der Sluys & Adolphson, LLP

[57] ABSTRACT

The invention relates to a sequin delivery system (1) for embroidery and/or sewing machines, in which a pusher (6) delivers sequins (3) from a sequin strip (2), which is at least partly guided laterally, in increments to a needle penetration point (24). A drive mechanism periodically moves the pusher (6) toward and away from the needle penetration point (24), and the pusher (6) has a slaving device, which on the motion of the pusher (6) in the direction of the needle penetration point (24) engages a hole (4) in a sequin (3). The pusher (6) is at least partially elastic, and in particular is a leaf spring, and presses the sequin strip (2) against a contact pressure plate (8).

12 Claims, 3 Drawing Sheets

SEQUIN DELIVERY SYSTEM FOR EMBROIDERY AND/OR SEWING MACHINES

FIELD OF THE INVENTION

The invention relates to a sequin delivery system for embroidery and/or sewing machines, in which a pusher delivers sequins from a sequin strip, which is at least partly guided laterally, in increments to a needle penetration point, and a drive mechanism periodically moves the pusher toward and away from the needle penetration point; the pusher has a slaving means which, when the pusher is moved in the direction of the needle penetration point, engages a hole in a sequin.

BACKGROUND OF THE INVENTION

Sequins are supplied to the system in a half-finished punched state, in the form of a coherent strip of sequins wound onto a bobbin. A circular hole is usually punched in the sequin and is penetrated by the embroidery needle, so that after the embroidery fabric is pierced, the sequin is secured to the embroidery fabric by the embroidery thread or threads used in the embroidering or sewing. Once the needle has plunged into the embroidery fabric, the part of the sequin strip that protrudes freely past the cutting edge of the knife at this time, or in other words the sequin to be stitched, is severed by a knife at a point specified by the pre-punched outer contour of the sequin strip, thus completing the sequin contour.

The holes punched in the sequins are used not only as a penetration opening for the needle but also serve to transmit the feed motion, which in the known systems is supplied in partial increments to the needle penetration point by a so-called wart wheel, or, as known from German Utility Model G 92 09764, by means of a slaving means formed onto a pusher.

Sequin delivery systems that transport the sequin strip by means of a wart wheel have the disadvantage that because of production tolerances of the sequin strip and the slaving pins of the wart wheel, the slaving pins engaging the holes in the sequins have a certain play, thus allowing the sequin strip to shift excessively in the feed direction. This effect is exacerbated by the fact that, typically, from 3 to 4 slaving pins engage successive sequins at the same time. The possible shifting of the sequin strip relative to the needle penetration point because of the play means that even if the other drive and detent elements involved in the transport operate without play, the separation point specified by the prepunched outer contour of the sequin strip may be missed by the amount of the play, resulting in an undesired zig-zagging outer contour that greatly impairs the quality of the embroidery, since this abnormal sequin shape is obvious to the naked eye if there are even only slight deviations.

In the sequin delivery system known from the aforementioned G 92 09764, the use of only a single slaving means assures that the quality of the embroidery depends only on the production tolerances of the sequin strip. The slaving means is formed onto the pusher, and the pusher rests on the sequin strip by spring action. The pusher is formed as a two-armed lever which is pivotably supported on a drive lever; one arm has the slaving means, while the other arm is joined to the drive lever via a spring. So that the slaving means can positively engage the repeating form elements of the sequin strip during the transport stroke on the one hand and on the other can move in the idle stroke without entraining the sequin strip, the slaving means has a nearly vertical stop face relative to the plane on its front side in the feed direction and an inclined slide face on the back. An additional brake element presses the sequin strip against a contact pressure or knife plate, and the brake element laterally guides the sequin strip.

A disadvantage of the sequin delivery system of G 92 09764 is that it requires relatively many parts to drive the pusher and for the brake element.

SUMMARY OF THE INVENTION

It is therefore an object of the invention to furnish a sequin delivery system that comprises only a few parts and nevertheless assures exact delivery of the sequin strip.

According to the invention, this object is achieved in that the pusher is at least partially elastic and, in particular, is a leaf spring and presses the sequin strip against a contact pressure plate. Because the pusher is elastic, no additional spring elements are needed. The contact pressure force is advantageously generated by the pusher itself. The flexibility of the pusher moreover cancels out production tolerances with regard to the height of the sequin strip, without impairing the feed.

In a preferred embodiment, a portion of the leaf spring is bent at an angle in the direction of the sequin strip, and the angled portion is the slaving means. The slaving means is a tablike part, in particular triangular in shape, which is formed onto the pusher on one side, that is, the side remote from the needle penetration point. It is especially advantageous if the angled portion is formed onto the end of the pusher. However, it is also conceivable for the tab to be punched halfway out of the leaf spring and then bent at an angle. Thus the angled portion forms a hook, whose side remote from the hook open side forms a slide face. If the pusher is moved by the drive mechanism toward the needle penetration point, then the slaving means is pressed into a hole in the sequin and by means of the slaving hook transports the sequin strip toward the needle penetration point by a distance that is adjustable at the drive mechanism. If the pusher is moved away from the needle penetration point, then the slaving means slides out of the hole in the sequin, because of the oblique slide face. The pusher is moved away from the needle penetration point by at least the distance of the diameter of one sequin, so that it will always be assured that the slaving means can engage the proper sequin hole upon the next feed motion.

Preferably, the leaf spring is fastened by one end to a lever, and the lever is rotatable by means of a drive mechanism about a shaft. The leaf spring with its other end exerts pressure on the sequin strip, while the slaving means is disposed on the other end. If the lever is rotated, the end of the leaf spring that has the slaving means is either pulled away from or pushed toward the needle penetration point. The leaf spring is tensed in all possible rotary positions of the lever, in such a way that it presses the sequin strip against the contact pressure or knife plate with an adequate pressure. The deflection of the lever for the feed and retraction motion of the slaving means is dependent on the length of the lever and on the bending of the leaf spring. The greater the distance between the fastening point of the leaf spring and the axis of rotation of the lever, the smaller becomes the necessary angle of rotation of the lever for a constant sequin diameter.

The pivoting motion is advantageously limited in both directions by means of a limiting element, and as a result only slight demands need to be made on the drive mechanism or on the production tolerances of the components used in the drive mechanism. In an especially simple embodiment, the limiting element is a U-shaped part, and its two legs each form one limitation for the pivoting of the lever. Adjusting screws are advantageously provided for that purpose on the legs; each screw can be screwed into a thread of the respective leg. Depending on how far the adjusting screw has been screwed into the leg, the pivoting motion or the maximum pivoting angle in the application direction can be predetermined extremely accurately. By means of such an embodiment, it is possible to dispense with sensors and the attendant complicated and expensive control of the drive mechanism. If sequins of various sizes are successively attached to the embroidery fabric by the embroidery or sewing machine, then it suffices to adjust the maximum pivoting angle of the lever for the particular sequin size by means of the adjusting screws.

An especially simple embodiment is obtained if the brake element is a spring, especially a leaf or spiral spring, and the spring is firmly supported by one end on the sequin delivery system and by its other end presses the sequin strip against a contact pressure plate, such that the sequin strip can be transported toward the needle penetration point only if the force of adhesion and/or friction generated by the brake element is overcome.

Possible embodiments of the invention will be described in further detail below in conjunction with the drawings.

DETAILED DESCRIPTION OF THE PREFERRED EMBODIMENTS

Figure 1:
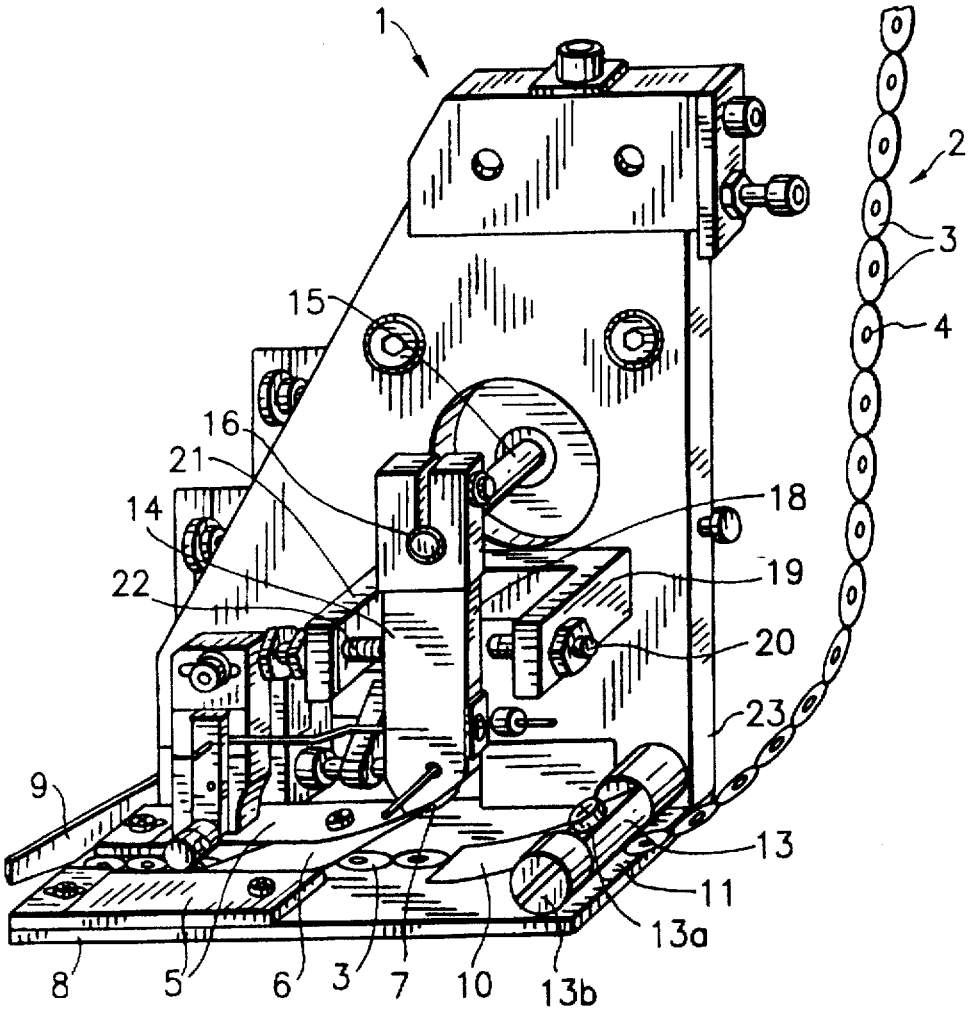
FIG. 1 is a perspective view of a sequin delivery system with a sequin strip in place in it.

FIG. 1 shows a sequin delivery system 1, to which a sequin strip 2 is supplied from a roll, not shown. The sequin strip 2 is introduced through a slit 11 into the sequin delivery system; the slit 11 is formed by the fastening device 13 of the brake element 10 and by the contact pressure plate 8. The height of the slit 11 is greater than the greatest thickness of the sequins 3 used. A leaf spring 10 is curved by means of the adjusting screw **13*b*, which at the same time serves to fasten the fastening device 13 to the base plate 23 of the sequin delivery system 1, in such a way that the sequin strip 2 is held with a certain contact pressure between the leaf spring 10 and the contact pressure plate 8. By means of the leaf spring 10, which acts as a brake element, the sequin strip 2 is pressed against the contact pressure plate 8 and rests flatly on it all the way to the needle penetration point 24**.

By means of the guide rails 5, the sequin strip 2 is guided laterally; the guide rails 5 are releaseably secured by screws to the contact pressure plate 8, so that the width of the guide channel formed by the guide rails 5 can be adapted to the diameter of the particular sequins 3 to be sewn or embroidered to the embroidery fabric.

Figure 1B:
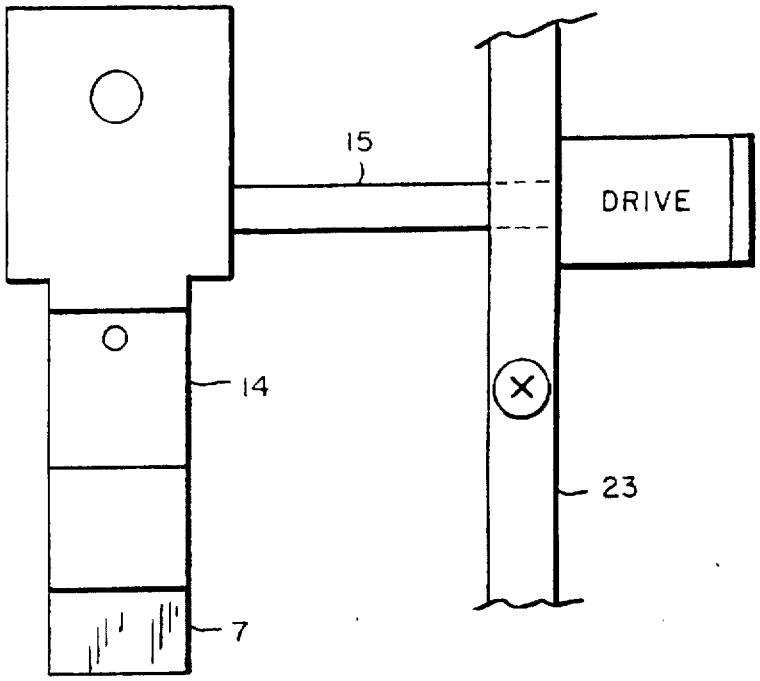
FIG. 1*b* is a view from the right side of FIG. 1, illustrating schematically the rotary drive of the lever.

The sequin strip 2 is pressed against the contact pressure plate 8 by the curved leaf spring 6; the sequin strip 2 can slide out of the guide channel only in the direction V. As can be seen from FIGS. 3*a* or 3*b*, in the relaxed state the leaf spring 6 is flat, except for the tip **6*a* that is bent downward, or in other words in the direction of the contact pressure plate 8 or sequin strip 2, and it has an opening on one end 7 through which a retaining screw passes and retains the leaf spring 6 on the lower end of the lever 14. The lever 14 is secured to the shaft 15** driven by the drive mechanism, shown in FIG. 1*b*; as a result, upon rotation of the shaft 15, the leaf spring 6 is moved either in the feed direction V, that is, toward the needle penetration point 24, or away from it, in a retraction direction R. Both pivoting motions, in the directions V, R of the lever 14, are limited by the legs 19, 21 of the U-shaped limiting part, which is secured to the base plate 23 of the sequin delivery system 1. To that end, fastening screws 20, 22 are retained on the legs 19, 21 by means of threads and can be screwed into the thread to a variable depth, which depends on the dimensions of the sequins 3 to be stitched.

Figure 2:
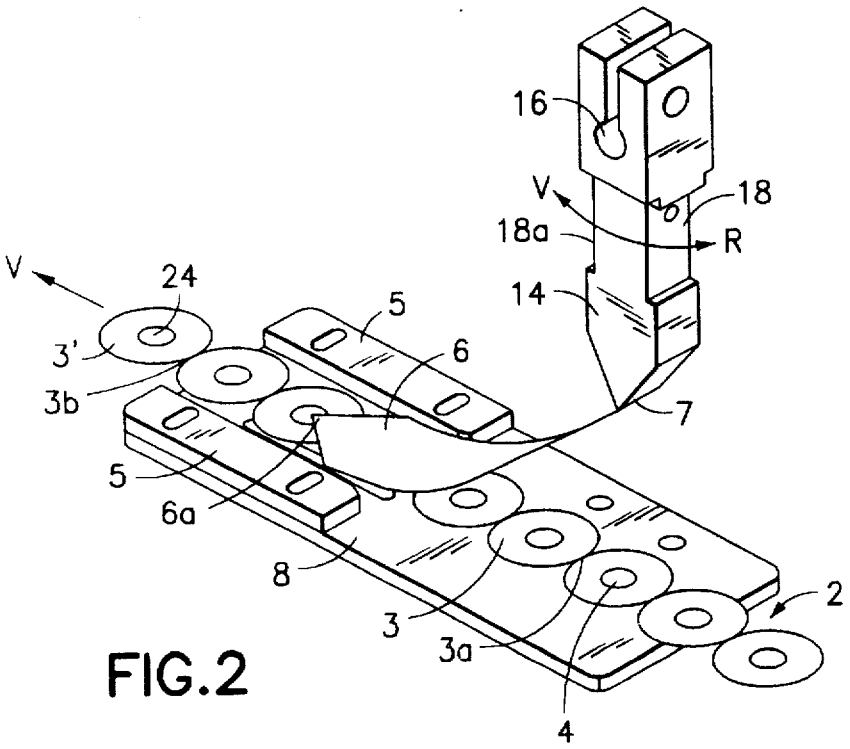
FIG. 2 is a perspective view of the curved leaf spring.
Figure 3A:
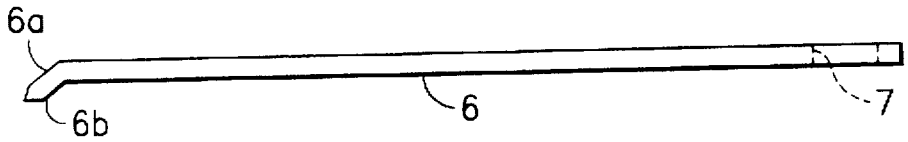
FIGS. 3*a* and 3*b* show a side view and a plan view, respectively, on a leaf spring acting as a pusher and slaving means.
Figure 3B:
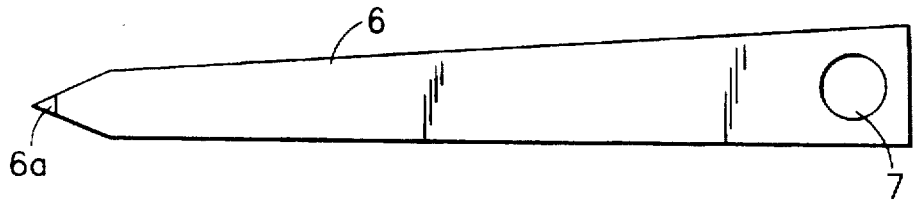

The leaf spring 6 is always curved in all pivoting positions, and as a result there is always pressure exerted on the sequin strip 2. If the lever 14 is pivoted in the direction R, or in other words away from the needle penetration point 24, as can be seen from FIG. 2, then the leaf spring 6 secured to the lower end of the lever 14 is moved away from the needle penetration point 24. As FIGS. 3*a* and 3*b* show, the end **6*a* of the leaf spring is bent slightly at an angle in the direction of the sequin strip 2, creating a slide face 6*b* that is slightly inclined from and points to the sequin strip 2, as a result of which the tip 6*a* of the leaf spring 6, on the pivoting motion V of the lever 14, seeks to move the sequin strip 2 away from the needle penetration point 24. However, because the leaf spring 10 also exerts pressure on the sequin strip 2 toward the contact pressure or knife plate 8, specifically with a greater contact pressure force, the leaf spring 6 is bent upward in such a way that the tip 6*a* of the leaf spring 6 slides out of the hole 4 of the sequin 3. The sequin strip 2 is thus arrested in the pivoting motion R of the lever 14**.

If the lever 14 is pivoted in the direction V, then the angled tip **6*a* of the leaf spring 6 slides into the intended hole 4 in the sequin 3. From this moment or angle of rotation on, the leaf spring 6 no longer slides over the sequin strip 2 but instead, by its barb action, pushes the sequin strip 2 in the direction V toward the needle penetration point 24. As soon as the entire pivoting motion has been executed by the lever 14, or in other words as soon as the lever with its face 18*a* strikes the end of the adjusting screw 22, the needle, not shown, pokes through the sequin 3' located in the needle penetration point 24 and holds the sequin in position. The sequin 3' that is to be attached by embroidering or stitching is then severed from the sequin strip 2 at the point 3*b* by a knife 9**.

What is claimed is:

1. A sequin delivery system (1) for embroidery and/or sewing machines, comprising a contact plate (8);

guide means (5) on said contact plate (8) forming a channel for a strip (2) of sequins (3) toward a needle penetration point (24);

a pusher (6) which delivers sequins (3) from said sequin strip (2), in increments toward said needle penetration point (24), a drive mechanism which periodically moves the pusher (6) toward and away from the needle penetration point (24), and a slaving means, connected to said pusher (6), which on the motion of the pusher (6) in the direction of the needle penetration point (24), engages a hole (4) in a sequin (3), wherein the pusher (6) is a leaf spring which presses the sequin strip (2) against said contact plate (8).

2. The sequin delivery system (1) of claim 1, wherein said leaf spring includes an angled portion (6*a*) which, with respect to a remaining portion of the leaf spring (6), is bent at an angle, in the direction of the sequin strip (2), and the angled portion (6*a*) is the slaving means.

3. The sequin delivery system (1) of claim 2, wherein the angled portion (6*a*) a hook shape having on one side a convex surface and, on a side remote from the convex surface, defines a slide face (6*b*) for said sequins.

4. The sequin delivery system (1) of claim 2, further comprising a pivotable lever (14) having a pivot end and a free end wherein the leaf spring (6) is fastened by a first end (7) thereof to said free end of said lever (14), and the lever (14) is rotatable by said drive mechanism about a shaft (15), and the leaf spring (6) has a second end (6*a*) which exerts pressure on the sequin strip (2).

5. The sequin delivery system (1) of claim 1, wherein an end (6*a*) of the leaf spring, remote from said connection to said pusher, points in the direction of the sequin strip and forms the slaving means.

6. The sequin delivery system (1) of claim 5, wherein said remote end (6*a*) of the leaf spring is bent at an angle in the direction of the sequin strip and forms the slaving means.

7. The sequin delivery system (1) of claim 1, wherein the motion of the lever (14) about the shaft (15) is alternately in a feed direction (V) of said sequin strip and in a retraction direction (R) of said sequin strip and is limited by a limiting element (19, 21).

8. The sequin delivery system (1) of claim 7, wherein the limiting element is U-shaped with two legs (19,21) and at least partly brackets the lever (14) with its two legs (19, 21), and each leg (19, 21) limits the pivoting motion of the lever (14) in one direction.

9. The sequin delivery system (1) of claim 8, wherein at least on one leg (19, 21), there is an adjusting screw (20, 21) whose end serves as an adjustable stop for the pivoting motion.

10. The sequin delivery system (1) of claim 1, further comprising a brake element (10) which presses the sequin strip (2) against the contact plate (8).

11. The sequin delivery system (1) of claim 10, wherein the brake element (10) is a spring.

12. The sequin delivery system (1) of claim 10, wherein the brake element (10) presses the sequin strip (2) against the contact plate (8) with an adjustable force, such that the sequin strip (2) is movable toward and away from the needle penetration point only by overcoming a tensile force that corresponds to a force predetermined by means of the brake element (10).

* * * * *